United States Patent [19]

Doyen et al.

[11] 4,346,877

[45] Aug. 31, 1982

[54] DEVICE FOR HANDLING SHEET-LIKE PIECES

[75] Inventors: Joël Doyen, Ste Savine; Jean-Pierre Raisin, Troyes, both of France

[73] Assignee: Agence Nationale de Valorisation de la Recherche, Neuilly, France

[21] Appl. No.: 148,507

[22] Filed: May 9, 1980

[30] Foreign Application Priority Data

May 17, 1979 [FR] France ..... 79 12639

[51] Int. Cl.³ ..... B65H 3/26

[52] U.S. Cl. ..... 271/19; 221/210; 271/18

[58] Field of Search ..... 271/18, 19, 18.3, 24, 271/25, 10, 16, 20, 21, 22, 23, 1; 414/120; 221/210

[56] References Cited

U.S. PATENT DOCUMENTS

| | | | |
|---|---|---|---|
| 609,968 | 8/1898 | Larson | 271/21 |
| 3,064,968 | 11/1962 | Starnes | 271/19 |
| 3,253,824 | 5/1966 | Southwell et al. | 271/19 |
| 3,353,821 | 11/1967 | Smith et al. | 271/25 X |
| 3,588,091 | 6/1971 | Stone et al. | 271/19 |
| 3,813,094 | 5/1974 | Walton et al. | 271/18.3 X |

FOREIGN PATENT DOCUMENTS

| | | |
|---|---|---|
| 1453273 | 8/1966 | France . |
| 2011087 | 2/1970 | France . |
| 2041874 | 2/1971 | France . |
| 2049800 | 3/1971 | France . |
| 2188579 | 1/1974 | France . |

*Primary Examiner*—Bruce H. Stoner, Jr.
*Attorney, Agent, or Firm*—Poms, Smith, Lande & Rose

[57] ABSTRACT

The present invention relates to a device for handling sheet-like pieces, whereby a swell is made on a zone of a piece in sheet form by pressing the latter between the support and a pressing member, the piece is gripped at the level of this zone, between the pressing member and a finger, and the piece thus gripped is displaced with respect to the support. The invention is more particularly applicable to the handling of pieces of material stacked in a pile.

10 Claims, 8 Drawing Figures

Fig. 1
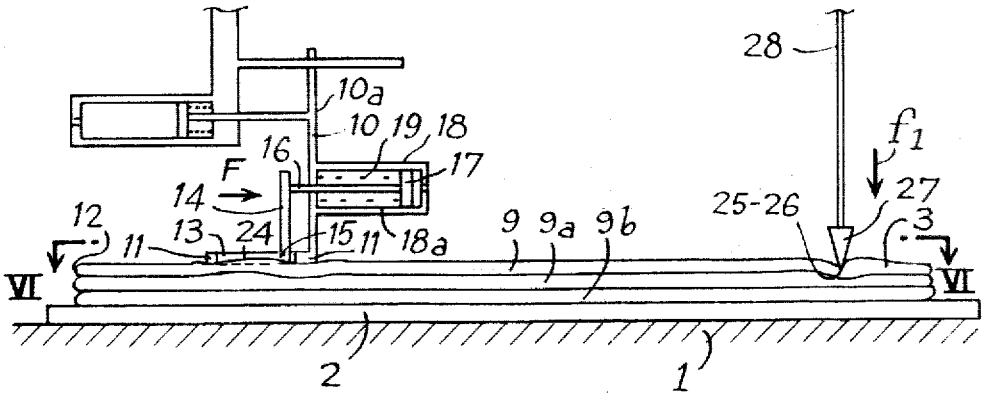
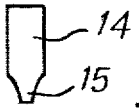
Fig. 1a
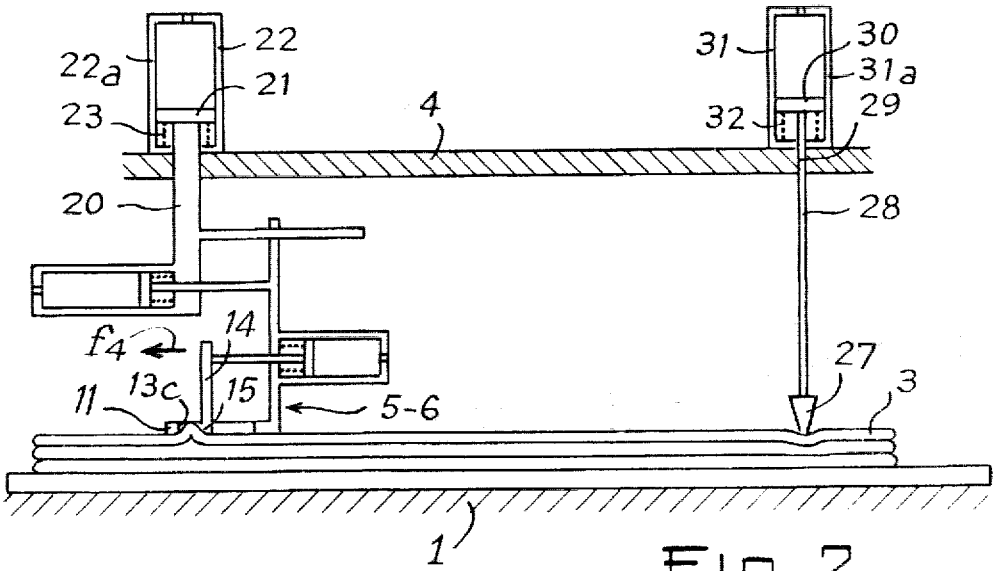
Fig. 2

DEVICE FOR HANDLING SHEET-LIKE PIECES

The present invention relates to a device for handling a piece in the form of a supple, elastically compressible sheet such as a piece of material—or fabric—, resting on a support, of the type comprising:

a frame on which the support is mounted, at least one gripping means comprising: a gripper body and at least two elements mounted to move with respect to each other on this body, means for displacing these elements with respect to one another, means for mounting this body on the frame so that said body is movable between, on the one hand, a first position for which at least one of the gripping elements is in abutment on the piece to be handled resting on the support and, on the other hand, at least one second position for which said gripping element is in spaced apart relationship with respect to said support, means for displacing the gripper body between the first and second positions.

U.S. Pat. No. 3,588,091 discloses a device for gripping a piece in the form of a supple and elastically compressible sheet such as a piece of material resting on a support. According to this prior art:

(a) a swell is made over a so-called swelling zone in the piece by pressing this latter between said support and the gripping elements;

(b) the piece is gripped by this swelling zone, between said gripping elements; and (c) said piece thus seized by its part gripped between said gripping elements is displaced with respect to the support.

In this known device, the movement of application with a certain pressure of the gripping elements on the piece to be gripped, as well as the movement bringing the gripping elements closer to one another, take place simultaneously.

When it is desired to grip the top piece of a stack of sheet-like pieces, by means of this known device, it is necessary to previously adjust the initial width of the slits existing between the gripping elements to a suitable value in order to avoid gripping, at the same time, the sheet located immediately beneath the top piece. This suitable value is a function of the characteristics of the sheet-like pieces to be handled, and particularly of the thickness of these sheets. Such an adjustment must therefore be made every time the characteristics of the sheets to be handled are changed.

The invention remedies this drawback and its particular object is to propose a device for handling sheet-like pieces which does not require such adjustments.

For a handling device of the type mentioned at the beginning of the preamble, this object is attained according to the invention in that one of the gripping elements, called first element is adapted to act as a swelling member able to make a swell over a so-called swelling zone in the piece, by abutting on a zone thereof surrounding, at least partially, the swelling zone, whilst the means for displacing the gripping elements are arranged to displace the other gripping element, with respect to the first element, in a direction parallel to the extension of the piece to be handled so as to grip said piece by said swelling zone, between the gripping elements.

In this way, in the device according to the invention, the process of gripping and lifting the piece to be handled is carried out as follows: the first gripping element is firstly applied with a certain pressure on this piece. Then, this first element being maintained fixed in abutment on the piece, the second element is displaced towards the first element in a direction substantially parallel to the extension of the piece to be gripped, i.e. in a direction substantially at right angles to the force of abutment of the first element on the piece to be gripped. The following two movements: (1) movement of application of the first element on the piece and (2) movement bringing the gripping elements closer to each other may thus, due to the invention, be separated in time. Accordingly, the initial value of the width of the space existing between the two gripping elements at rest, i.e. before they are mutually brought closer to each other, need not be adjusted to a precise value defined as a function of the characteristics of the piece to be gripped.

When the gripper body is in its first position, the two gripping elements are advantageously in abutment on the piece to be handled, by support surfaces of different values: the support surface of the first element being larger than that of the second element.

The second element is advantageously mobile with respect to the first element between, on the one hand, a first position for which this second element is spaced, by a so-called gripping part, from the first element and, on the other hand, a second position for which the second element is urged towards said gripping part so as to grip the piece by the swell between the second element and the gripping part.

The first element is advantageously arranged to press the piece over a zone surrounding the swelling zone only on three sides and said gripping part is that part of the first element coinciding with the side of the swelling zone opposite the free side of this zone.

The device advantageously further comprises means for holding the piece on the support in a so-called holding zone which is spaced apart from the swelling zone and which is preferably located at one end of the piece, these holding means pressing this zone between a pressing member and the support, and means for applying on the gripper body a substantially coplanar force with respect to the piece and directed opposite the holding zone and for separating said body from said support.

The first gripping element advantageously abuts on the piece to be handled by a so-called pressing wall, provided with an opening of which one of the sides, a so-called gripping side, is intended for cooperating with the other gripping element, and this latter element is a finger which is engaged in said opening and which is mounted on the gripper body movable with respect to said wall between a first position for which it is spaced from said gripping side and a second position for which it is applied with a certain pressure against the gripping side.

At least one upper end layer of the support is advantageously elastically compressible.

The piece to be gripped is advantageously the top piece of a pile of pieces in sheet form, which are supple and elastically compressible, resting on the support.

The opening of the pressing wall advantageously presents an elongated shape and the gripping side coincides with an extreme edge of this opening.

The pressing wall advantageously defines this opening only on three sides, of which the central side coincides with the gripping side.

The invention will be more readily understood on reading the following description with reference to the accompanying drawings, in which:

FIG. 1 is a schematic view in elevation and in vertical section through a handling device according to one embodiment of the invention.

FIG. 1*a* is a view in the direction of arrow F of the plate 14 of the device shown in FIG. 1.

FIG. 2 is a view similar to FIG. 1 showing a second phase of the gripping process of the device of FIG. 1.

Figure 3:
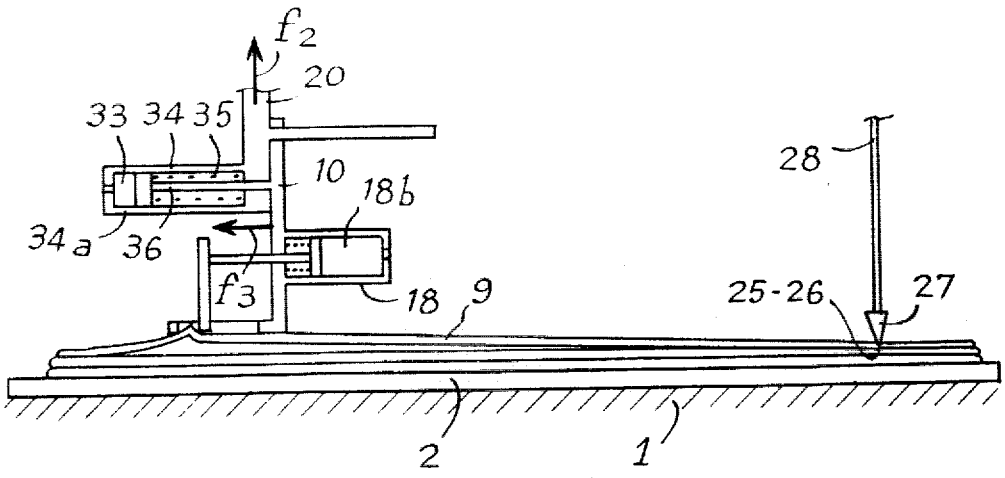
FIG. 3 is a view similar to FIG. 1 showing a third phase of the gripping process of the device of FIG. 1.

Referring now to the drawings, the handling device shown therein comprises a frame 1 on which is mounted a flat, horizontal support 2 for a stack 3 of pieces of material to be handled.

Figure 6:
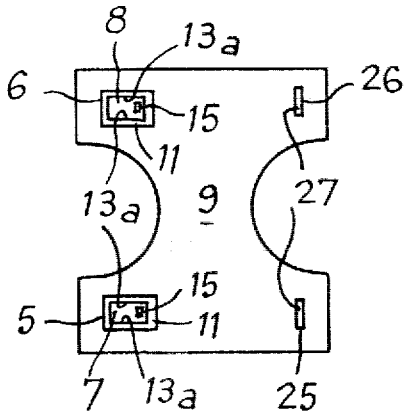
FIG. 6 is a plan view from the horizontal plane VI—VI of FIG. 1.

On a structural element 4 fixed to the frame 1 by means which have not been shown, two gripping means 5, 6 are mounted, each adapted to grip a so-called gripping zone 7, 8 of an edge of the top piece 9 of the stack 3 (FIG. 6).

In the example shown, the pieces 9, 9*a*, 9*b* are underpants made of stitched fabric, but the invention extends to the handling of all pieces in the form of supple, compressible sheets and, more particularly, to sheets further having a certain extensibility such as knitted pieces.

Each gripping means 5, 6 comprises a gripper body 10 of vertical flat shape terminating at the bottom in a flat horizontal pressing sole 11 extending towards the adjacent edge 12 of the piece 9; the sole 11 is provided with an opening 13, for example rectangular, whose large sides 13*a* are perpendicular to the gripper body 10. A vertical plate 14 parallel to the gripper body 10 and terminating downwardly in a finger 15 engaged in the opening 13 in the sole 11 is guided horizontally on the gripper body 10. The plate 14 is fixed to the free end of the rod 16 of the piston 17 of a single-action jack 18, with return spring 19, the axis of said jack 18 being horizontal and the casing 18*a* of which is fixed to the gripper body 10 and projects from the face 10*a* of said gripper body opposite the sole 11.

The gripper body 10 is mounted on a vertical support 20 fast with the piston 21 of a jack 22 of vertical axis, whose casing 22*a* is fixed to the structural element 4, this jack 22 being of the single-acting type and having a return spring 23.

Figure 4:
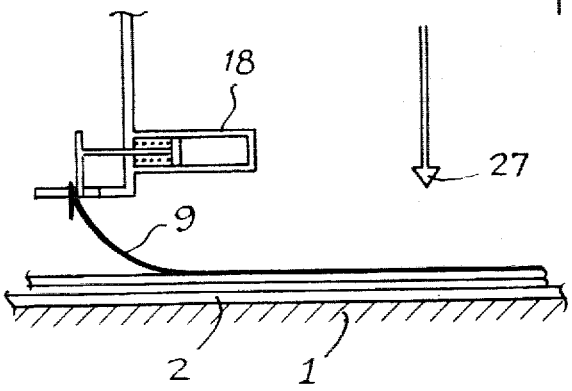
FIG. 4 is a view similar to FIG. 1 showing the final position of the gripping process of the device of FIG. 1.

According to the particular embodiment of the present invention, the sole function of the handling device is to lift, by a certain height, the adjacent end of the edge 12 of the top piece 9 of the pile 3 as shown in FIG. 4. This operation takes place as follows:

(1) a swell 24 is made on each gripping zone 7, 8 of the piece 9 by pressing the latter between the support 2 and the pressing sole 11 (FIG. 1); this is obtained by supplying compressed fluid to the jack 22 controlling the descent/rise of the gripping means 5, 6.

(2) the piece 9 is gripped at the level of each swell 24 between the sole 11 and the finger 15 of the corresponding gripping means 5, 6 (FIG. 2); this is obtained by supplying compressed fluid to the jack 18 for controlling the tightening/loosening of the gripping means 5, 6.

(3) simultaneously with respect to the descent of each gripping means 5, 6 the piece 9 to be gripped is held at two points 25, 26 each located opposite a corresponding gripping zone 7, 8, by applying on each of these points 25, 26, with a certain pressure, a holding finger 27 provided at the lower end of a vertical rod 28 extending the likewise vertical rod 29 of a piston 30 of a single-acting jack 31 with return spring 32, the axis of said jack 31 being vertical and the casing 31*a* of which being fixed to the structural element 4. The descent (arrow $f_1$, FIG. 1) and the application with pressure of each of the holding fingers 27 are obtained by supplying compressed fluid to the corresponding control jack 31.

(4) the application with pressure of the holding fingers 27 on the points 25, 26 being maintained, the two gripping elements 5, 6 are raised (arrow $f_2$, FIG. 3); at the same time as this lifting movement, the gripping elements 5, 6 are imparted a horizontal movement directed opposite the holding points 25, 26 (arrow $f_3$, FIG. 3); the effect of this horizontal movement ($f_3$) is to facilitate the detachment of the top piece 9 with respect to the piece 9*a* located immediately therebeneath, by causing an extension of the top piece 9. This horizontal movement ($f_3$) is obtained for example by discharging the pressure chamber 33 of a jack 34 of horizontal axis, of the single-acting type and having return spring 35, the casing 34*a* of said jack 34 being fixed to the support 20 and the piston rod 36 of which being fast with the gripper body 10, this gripper body being mounted to slide horizontally on said support 20.

(5) gripping is terminated when the gripping means 5, 6 reach their extreme upper position (FIG. 4); the holding fingers 27 may then be raised.

Figure 5:
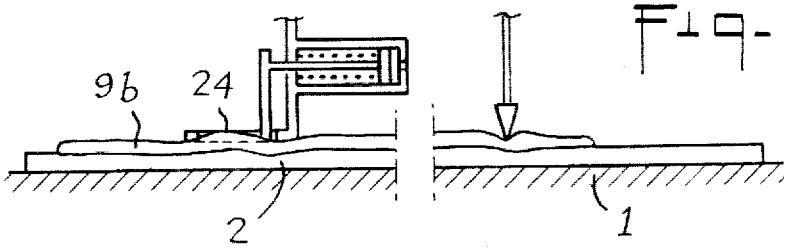
FIG. 5 is a view similar to FIG. 1 showing the gripping of the last sheet of the stack 3.

The support 2 is advantageously elastically compressible as shown in FIG. 5; due to this characteristic, the formation of the swell 24 is facilitated for the last piece 9*b* of the pile 3.

Figure 7:
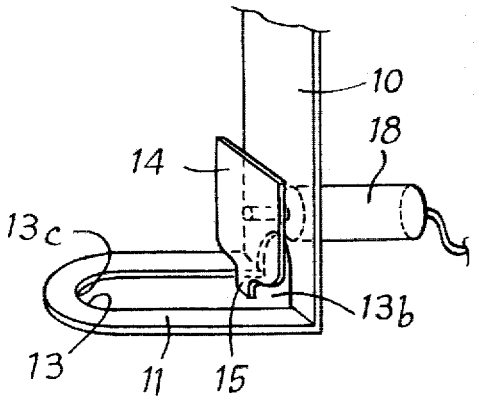
FIG. 7 is a view in perspective of another embodiment of a gripping member of the handling device of the invention.

FIG. 7 shows another embodiment of a gripping means 5, 6. According to this embodiment, the opening 13 of the pressing sole 11 is surrounded by the latter only on three sides, the fourth side 13*b* being located opposite the front end side 13*c*. This embodiment enables sheets having weak extensibility, such as woven fabrics, to be gripped.

In the case of the two embodiments, described hereinabove, of a gripping means 5, 6, the piece 9, 9*a*, 9*b* is gripped between the finger 15 and the front end side 13*c* of the opening 13 by the advance movement (arrow $f_4$, FIG. 2) of the plate 14.

Thus, the gripping elements 5, 6 of the device which has just been described are of simple design and do not require any particular member to be disconnected from the gripped piece; a simple discharge of the pressure chamber 18*b* of the jack 18 causes the gripping element to open, said opening leading without delay to the release of the piece.

The advance movement ($f_4$) of the plate 14 corresponds to the displacement of the finger 15 along a path coinciding substantially with the longitudinal axis of the opening 13 which is elongated in form. The length of the finger part 15 engaged in the opening 13 is chosen as a function of the type of sheet 9, 9*a*, 9*b* to be gripped, so that, during the advance movement of said finger 15, the subjacent piece 9a is not gripped, too, between the elements 11 and 15 to such an extent that it cannot be released during the simultaneous movements ($f_2$) and ($f_3$) of the gripping means.

Of course, any other means for displacing the mobile finger 15 may be used without departing from the scope of the present invention; in particular, an electro-magnet may be used to this end.

What is claimed is:

1. In a device for handling a piece of supple, elastically deformable sheet such as a piece of material comprising a frame and a sheet support mounted thereon, at least one gripping means mounted above the support for gripping the sheet, the gripping means comprising a gripper body and at least two gripper elements comprising first and second gripper elements mounted to move with respect to each other on the gripper body, displacing means associated with the gripping means for displacing the gripper elements with respect to one another, means for mounting the gripper body on the frame movable between a first position for which at least one of the gripper elements contacts the sheets and at least one second position for which the gripper elements are spaced apart from the support, means for displacing the gripper body between the first and second positions, the first gripper element having a swelling surface for at least partially enveloping a portion of the sheet when the gripper element is in its first position to cause the sheet to swell in the area enveloped by the first gripper element, and means for moving the second gripper element toward a portion of the first gripper element across the swell of the sheet to pinch the sheet between the two gripper elements.

2. The device of claim 1, wherein, when the gripper body is in its first position, the two gripper elements are pressing the sheet, the gripper elements having pressing surfaces of different areas, the pressing surface of the first gripper element being of larger area than that of the second element.

3. The device of claim 1, wherein the first gripper element having a gripping part, the second gripper element is mobile with respect to the first gripper element between a first position in which the second gripper element is spaced from the gripping part of the first gripper element and a second position in which the second gripper element is urged towards the gripping part so as to grip the piece by the swell between the second gripper element and the gripping part.

4. The device of claim 3, wherein the swelling surface of the first gripper element surrounds the swell with an opening in the surrounded area and the gripping part is that part of the first gripper element opposite the opening in the swelling surface.

5. The device of claim 1, further comprising hold-down means for holding the piece sheet on the support in a holding zone, which is spaced apart from the swell, the hold-down means pressing the sheet at the holding zone against the support, and means moving the second gripper element substantially parallel to the sheet and away from the holding zone.

6. The device of claim 1, wherein the swelling surface partially surrounds the swell except for an opening, the second gripper element having a finger in the opening and movable with respect to the swelling surface between a first position in which it is spaced from the swelling surface and a second position in which it is urged with a certain pressure against the swelling surface.

7. The device of claim 6, wherein the swelling surface is of an elongated shape and the second gripper element grips the sheet at the extreme edge of the swelling surface opposite the opening.

8. The device of claim 6, wherein the swelling surface has three sides extending from the opening, the second gripper element gripping the sheet at the central side of the swelling surface.

9. The device of claim 1, wherein at least one upper end layer of the support is elastically compressible.

10. The device of claim 1, wherein the sheet to be gripped is the top sheet of a pile of sheets is supple, elastically compressible sheets, resting on the support.

* * * * *